United States Patent [19]

Campbell et al.

[11] Patent Number: 4,882,805

[45] Date of Patent: Nov. 28, 1989

[54] SLIDER FOR WINDOW REGULATOR ARM

[75] Inventors: Adrian D. Campbell; William E. Rank, both of Dayton, Ohio

[73] Assignee: General Motor Corporation, Detroit, Mich.

[21] Appl. No.: 282,653

[22] Filed: Dec. 12, 1988

[51] Int. Cl.[4] ..... A47H 15/00; E05D 15/16; E06B 7/16

[52] U.S. Cl. ..... 16/93 R; 49/441; 49/428

[58] Field of Search ..... 16/93 R, 93 D; 49/441, 49/428, 414

[56] References Cited

U.S. PATENT DOCUMENTS 3,466,802 9/1969 Doveinis et al. ..... 49/428

3,466,803 9/1969 Packett ..... 16/93 R

*Primary Examiner*—Richard K. Seidel

*Assistant Examiner*—Carmine Cuda

*Attorney, Agent, or Firm*—William A. Schuetz

[57] ABSTRACT

A slider, for use in slidably connecting a balance arm of a window regulator mechanism to a guide member having a pair of spaced planar edge portions defining a linear slot therebetween is disclosed. The slider is molded from a one piece plastic material and has a main body portion disposed within the slot of the guide member and first and second offset pairs of legs for engaging and straddling the opposite sides of the guide member in a manner to prevent twisting of the slider in a horizontal plane when it is reciprocably moved within the guide slot. One of the pairs of legs is provided with deflectable ears so that both pairs of legs are biased into engagement with the guide member on opposite sides thereof to prevent rattling therebetween. In addition, the main body portion of the slider at its top and bottom is provided with pairs of deflectable cantilevered fingers for biasingly engaging the edge portions of the guide member at their end faces to prevent binding due to twisting in a vertical plane and to prevent rattling therebetween.

5 Claims, 1 Drawing Sheet

SLIDER FOR WINDOW REGULATOR ARM

The present invention relates to a slider for slidably engaging a slotted guide member and, more particularly, to a one piece plastic slider for slidably engaging spaced planar edge portions of a slotted guide member in a manner such that rattling therebetween is prevented.

Side doors for automotive vehicles commonly have windows which are vertically movable between open and closed positions. These doors also have mounted therein a window regulator mechanism operatively connected with the window for effecting movement of the window between its positions. One such mechanism is a cross arm type window regulator mechanism, such as shown in U.S. Pat. Nos. 3,466,803 and 3,888,047. In such mechanisms a drive arm and balance arm are pivotally connected to each other intermediate their ends and with one end of the arms being slidably connected to a sash channel on the window via rollers, the other end of the drive arm being connected to a sector gear and the other end of the balance arm being slidably connected with a stationary C-shaped guide channel or member via a roller. It is also known to replace the rollers with sliders which slide within the guide channels. In order to reduce binding between the slider and guide channel and prevent rattling therebetween, the sliders have been provided with integral bowed deflectable portions which engage the opposite sides of the channel. In addition, it is also known to provide ears, etc. on the slider to engage the back inside surface of the channel to bias the slider into engagement with the inside surfaces of the lips of the front side of the C-shaped channel.

It has also been proposed to use a guide member formed by a simple sheet metal stamping, preferably stamped or punched out of the inner door panel, which has a slot therethrough, the slot being defined by a pair of spaced planar edge portions of the guide member. Such guides are shown in U.S. Pat. Nos. 2,850,333 and 3,888,047. While this latter type of guide member is of a more economical construction than a separate C-shaped channel which must be welded or otherwise secured to an inner door panel, it does require a more complicated roller assembly at the end of the balance arm. While sliders in place of rollers have also been proposed for the use with such a guide member, they have usually had a loose fit with the guide member in order to reduce binding between the guide member and the slider with the resultant disadvantage that rattling oft times occurs therebetween.

The present invention contemplates using a simplified guide member as described immediately above, and a novel slider which extends through the slot and straddles both the front and backsides of the edge portions of the guide member. The novel slider is molded in one piece from a suitable plastic material and has a main body portion disposed within the slot of the guide member and first and second offset pairs of legs for engaging and straddling the opposite sides of the guide member in a manner to prevent twisting of the slider in a horizontal plane when it is being reciprocably moved within the guide slot. One of the pairs of legs is provided with a deflectable ear so that both pairs of legs are biased into engagement with the guide member to prevent rattling therebetween. In addition, the main body portion of the slider at its top and bottom is provided with a pair of deflectable cantilevered fingers for biasingly engaging the edge portions of the guide member at their end faces to prevent twisting in a vertical plane and to prevent rattling therebetween so that the slider can be reciprocably moved along the guide member without binding, with a minimal amount of friction and wherein rattling is prevented or substantially prevented.

Accordingly, it is a broad object of the present invention to provide a new and improved slider for use with a guide member having spaced planar edge portions defining a slot and in which the slider is of a one piece plastic construction, straddles both sides of the guide member so as to be highly stabilized when slidably connected thereto, has deflectable ears and fingers for biasingly engaging the edge portions of the guide member in a manner such that binding between the slider and guide does not occur, such that friction between the slider and the guide member is minimized and such that rattling therebetween is prevented or substantially prevented.

Yet another object of the present invention is to provide a new and improved slider, as defined in the preceding object, and in which the slider has a generally rectangular overall shape, and in which the first and second offset pairs of legs engage the opposite sides of the side edge portions of the guide member at diagonally spaced locations so as to provide a four location engagement whereby the slider is highly stabilized when connected to the guide member.

A further object of the present invention is to provide a new and improved slider, as defined in the preceding objects, and in which pairs of spaced, curved cantilevered fingers biasingly engage the end faces of the spaced edge portions of the guide member at horizontally spaced locations to minimize friction therebetween and prevent rattling.

Yet another object of the present invention is to provide a new and improved slider, as defined in the next preceding object, and in which the main body portion is provided with recesses underneath the deflectable fingers so as to provide space for the deflectable fingers to deflect.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
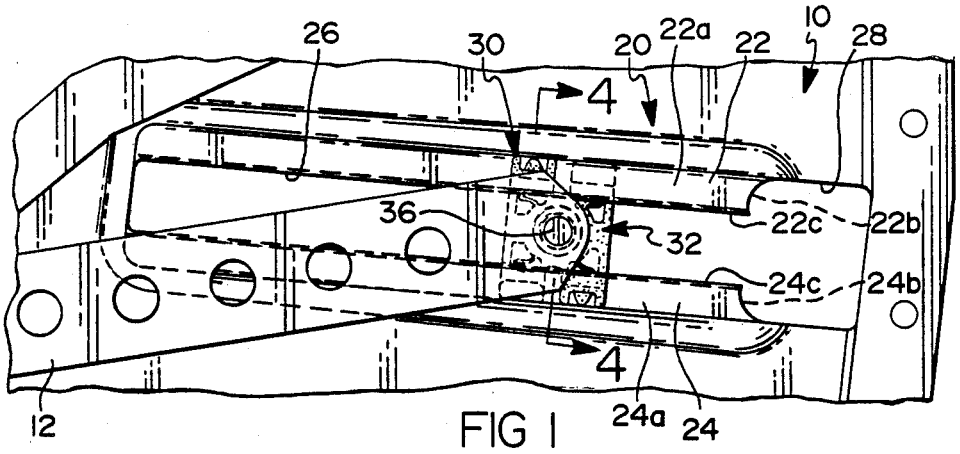
FIG. 1 is a fragmentary elevational view of an inner vehicle door panel having an integral guide member and the novel slider of the present invention, and showing the same pivotally connected to one end of a balance arm of a window regulator mechanism.

Referring to FIG. 1 of the drawings, there is shown an inner door panel 10 stamped from suitable sheet metal, to which a suitable cross arm window regulator (not shown) is adapted to be mounted. Since the window regulator mechanism per se does not form any part of the present invention, it is not shown in the drawings and will not be described in detail. Suffice it to say the window regulator mechanism could be of the type shown in U.S. Pat. Nos. 3,466,803 or 3,888,047. The only part of the cross arm window regulator mechanism shown in the drawings is a balance arm 12. As is well known in the art, the lower end of the balance arm 12 of a cross arm window regulator is slidably connected to a guide member or channel for reciprocable movement relative thereto.

The inner door panel 10 is stamped so as to provide an integral guide member 20. The guide member 20 is generally step shaped, as viewed in cross section, to define a pair of spaced apart planar edge portions 22 and 24 which define therebetween an elongated linearly extending slot 26. The slot 26 is enlarged at one end, as indicated by reference numeral 28, and for a reason to be hereinafter more fully described. The edge portions 22 and 24 respectively have front faces **22*a* and 24*a*, rear faces 22*b* and 24*b* and end surfaces or faces 22*c* and 24*c* which face toward each other and define the linearly extending slot 26**.

Figure 4:
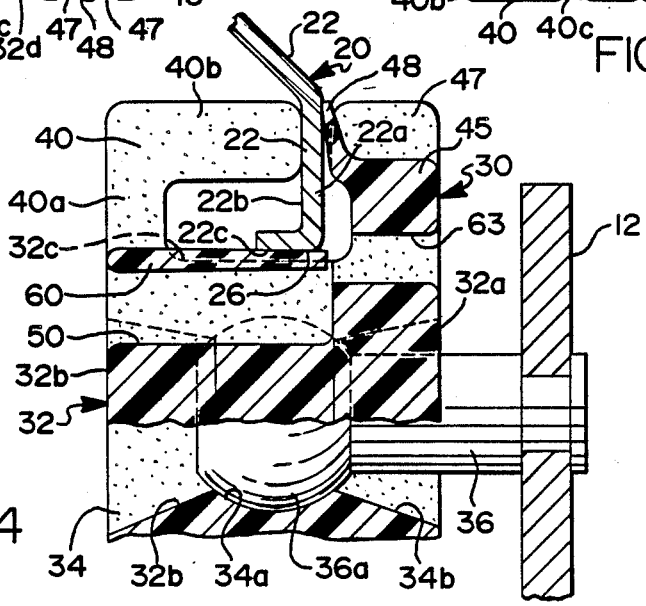
FIG. 4 is a enlarged fragmentary sectional view taken approximately along the lines 4—4 of FIG. 1.

In accordance with the provisions of the present invention, a novel one piece plastic slider 30 is provided to slidably connect the lower or free end of the balance arm 12 to the guide member 20. The slider 30 is of a generally rectangular shape and has a generally rectangularly shaped main body portion 32 having a central through opening 34. The opening 34 at the center or midpoint of the main body portion 32 has a spherical shape, as indicated by reference numeral **34*a*, to define a socket and has converging tapered portions 34*b* extending inwardly from the front and rear sides 32*a* and 32*b* of the main body portion 32 to the spherical portion 34*a*. The spherical socket portion 34*a* is adapted to receive a ball stud or swivel 36 via a snap fit. That is, the ball stud 36 has a ball 36*a* of a larger diameter than the smallest diameter of the tapered portions 34*b* and it is connected to the socket portion 34*a* by being press fitted through one of the tapered portions 34*b* until it is snap fittingly received within the socket portion 34*a*. The ball stud 36 can swivel within the socket 34*a* a limited extent so as to provide a limited universal connection with the slider 30. As best shown in FIG. 4, the ball stud 36 at its end remote from the ball 36*a* is adapted to be suitably connected to the free end of the balance arm 12** of the window regulator mechanism (not shown).

Figure 2:
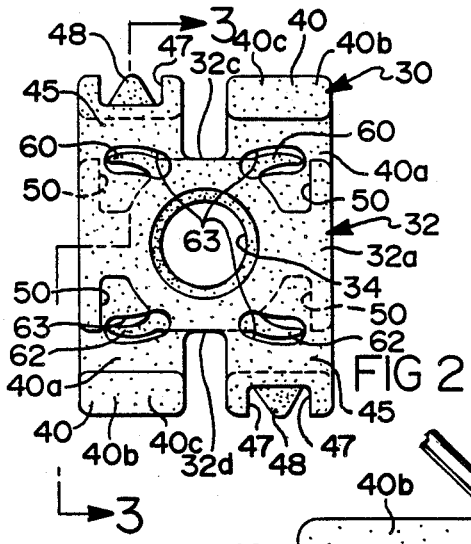
FIG. 2 is an enlarged side elevational view of the novel slider of the present invention.
Figure 3:
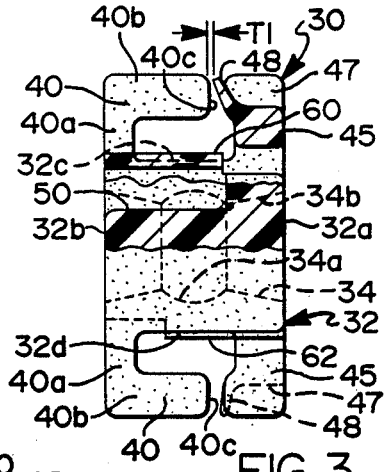
FIG. 3 is a sectional view of the novel slider and taken in the direction of the arrows 3—3 of FIG. 2.

The slider 30 has a first pair of laterally offset leg portions 40 which are adapted to engage the backsides **24*b* and 22*b* of the edge portions 24 and 22 of the guide member 20, respectively. As best shown in FIGS. 2 and 3, the leg portions 40 are each generally L-shaped to define a vertically extending leg 40*a* and a horizontally extending leg 40*b*. The vertically extending leg 40*a* is coplanar with the backside 32*b* of the main body portion 32 and the horizontally extending leg 40*b* overlies the main body portion 32 a predetermined distance. As can be seen from FIG. 2, the leg portions 40 are at diagonally opposite locations relative to the main body portion 32 so that one extends upwardly from and overlies the top or top side 32*c* of the main body portion 32 and the other one extends downwardly from and overlies the bottom or bottom side 32*d* of the main body portion 32**.

The slider 30 further includes a second pair of laterally offset leg portions 45 which are adapted to engage the front sides **22*a* and 24*a* of the side edge portions 22 and 24 of the guide member 20, respectively. The leg portions 45 extend vertically from the main body portion 32 and are coplanar with the front side 32*a* of the main body portion 32. As best shown in FIG. 2, the leg portions 45 are located at diagonally opposite locations relative to the main body portion 32, with one of the legs 45 extending upwardly from the top side 32*c* of the main body portion 32 and the other one extending downwardly from the bottom 32*d* on the main body portion 32. Each of the leg portions 45 has a U-shaped recess 47 at its free end and an integral deflectable ear 48 disposed within the recess 47. The ears 48 have a normal free state position such that a vertical plane passing through the innermost point of their free ends is spaced from a vertical plane passing through the inner end surfaces 40*c* of the legs 40*b* a perpendicular distance T1 which is less than the thickness of the side edge portions 22 and 24 of the guide member 20**.

The one piece plastic slider 30 also has a plurality of recesses 50 in its main body portion which are generally trapezoidal in shape. The recesses 50 are in communication with either the top **32*c* or bottom 32*d* of the main body portion 32. Overlying the recesses 50 at the top side 32*c* of the main body portion 32 are a first pair of curved or convex deflectable fingers 60 and overlying the recesses 50 in the bottom 32*d* of the main body portion 32 are a second pair of deflectable fingers 62. The fingers 60 and 62 at their respective adjacent ends are integral with the main body portions 32, are supported in cantilever fashion and have a thickness which diminishes proceeding from their integral connection with the main body portion 32 towards their free ends. To enable the cantilever fingers 60 and 62 to be formed, the leg portions 40 and 45 are provided with kidney shaped slots 63 therethrough so that the fingers are unsupported at their free ends and along their sides. As best shown in FIG. 2, the perpendicular distance between horizontal planes containing the outermost surfaces of the deflectable fingers 60 and 62 is greater than the perpendicular distance between the end faces 22*c* and 24*c* of the side edge portions 22 and 24 of the guide member 20**, respectively.

The manner in which the slider 30 is connected to the guide member 20 will now be described. The overall dimensions of the slider 30 are less than the overall dimensions of the enlarged portion 28 of the slot 26. The slider 30 is connected to the guide member 20 by positioning the same within the enlarged portion 28 of the slot 26 and then sliding the same sideways so that the edge portions 22 and 24 are received within the gap between the end faces **40*c* of the leg portions 40 and deflectable ears 48 of the leg portions 45. When the side edge portions 22 and 24 are received between the respective legs 40 and 45, the ears 48 are caused to be deflected from the normal free state position, as shown in FIG. 3, toward a position, as shown in FIG. 4, in which the ears 48 not only engage the front sides 22*a* and 24*a* of the edge portions 22 and 24, but also bias and cause the end surfaces 40*c* of the legs 40 to engage the backside 22*b* and 24*b* of the edge portions 22 and 24. This biased engagement on the opposite sides of the edge portions 40 at diagonally opposite locations on the edge portions 22 and 24** provides for a highly stabilized connection in which horizontal twisting movement therebetween is either prevented or substantially prevented and such that rattling between the leg portions 40 and 45 of the slider 30 and the edge portions 22 and 24 cannot take place.

In addition, when the slider 30 is slidably connected to the guide member 20, the end surfaces 22c and 24c of the edge portions 22 and 24 slidably engage the deflectable fingers 60 and 62 and cause the deflectable fingers 60 and 62 to be deflected from their normal free state position, as shown in FIG. 2, toward the position shown in FIG. 4 in which the deflectable fingers biasingly engage the end surfaces 22c and 24c of the edge portions 22 and 24, respectively. This biased engagement prevents binding and undue twisting movement in a vertical plane about the axis of the ball stud 36 and also serves to prevent rattling between the slider and the guide member 20.

It should be noted that the slider 30 straddles the guide member as a result of its having diagonally opposite engagement points at four different locations and that the provision of the deflectable ears 48 and the deflectable fingers 60 and 62 minimizes frictional engagement between the slider 30 and guide member 20 and prevents rattling therebetween.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. In combination, a stationary guide member having opposed planar, spaced apart edge portions whose end faces define. a linear slot therebetween, a slider slidably connected to said guide member and which is adapted to be reciprocably moved along said slot of said guide member, said slider having a main body portion which is adapted to be received within said slot, a first pair of integrally formed generally L-shaped portions whose free ends overlie and are adapted to engage a side of one of said edge portions, a second pair of integrally formed portions each including a deflectable ear for overlying and engaging an opposite side of said edge portion and which biases the free ends of said L-shaped portion into engagement with said one side of said edge portions of said guide member, said main body portion having first and second integrally formed cantilevered deflectable fingers which biasingly engage said end faces of said edge portions when the main body portion is received within said slot of said guide member whereby said slider is at all times biased into engagement with said end faces and said opposite sides of said first and second edge portions so that rattling therebetween cannot occur.

2. In combination, a stationary guide member having opposed, spaced apart first and second edge portions which define a linearly extending slot therebetween, said first and second edge portions having a given thickness and each being defined by planar front and rear sides and an end face and with the end faces defining said slot and being spaced apart a predetermined distance from each other, a one piece, plastic, generally rectangularly shaped slider slidably connected to said edge portions of said guide member and which is adapted to be reciprocably moved along said slot of said guide member, said slider having a main body portion which is adapted to be received within said slot, first and second oppositely extending, laterally offset leg portions, said first and second leg portions extending upwardly and downwardly from the top and bottom of said main body portion and having an inner end face for engaging one of said front and rear sides of said first and second edge portions, respectively, third and fourth oppositely extending, laterally offset leg portions, said third and fourth leg portions extending upwardly and downwardly from the top and bottom of said main body portion and each having a deflectable ear for engaging the other of said front and rear sides of said first and second edge portions, respectively, said inner faces of said first and second leg portions lying in a first common plane and said inner most ends of said deflectable ears of said third and fourth leg portions lying in a second common plane, the perpendicular distance between said first and second planes, when the ears are in their free state position, being less than the given thickness of said edge portions, said ears being deflectable from their free state position when the slider is being slidably connected to the guide member whereby said ears bias said end faces of said first and second leg portions into engagement with said one side of said first and second edge portions, said main body portion having a first pair of spaced recesses extending inwardly from its top and a second pair of recesses extending inwardly from its bottom, said main body portion having top and bottom deflectable curved fingers overlying said first and second pairs of recesses, respectively, adjacent ones of said top and bottom curved fingers, when in their normal free state position having a maximum perpendicular distance therebetween which is greater than the perpendicular distance between the end faces of said first and second edge portions, said top and bottom fingers being deflectable toward each other when said slider is being slidably connected to said edge portions of said guide member whereby said fingers at all times biasingly engage said end surfaces of said edge portions and said ears engage said other side of said first and second edge portions to at all times bias said first and second leg portions into engagement with said one side of said first and second edge portions and rattling between the slider and guide member is prevented.

3. The combination, as defined in claim 2, and wherein said main body portion of said slider has a central opening defining a socket for snap fitting receiving a spherical ball stud which is adapted to be connected to a reciprocable balance arm of a window regulator mechanism.

4. The combination, as defined in claim 2, and wherein said first and second leg portions are L-shaped to each define a first leg coplanar with an outer side of said main body portion and a second leg overlying either said top or bottom of said main body portion, and wherein said ears of said third and fourth leg portions are located in a recess formed in said third and fourth leg portions.

5. The combination, as defined in claim 4, and wherein each of said leg portions has a kidney shaped slot in communication with said recesses in said main body portion whereby said deflectable finger and each unsupported at their free ends and along their sides.

* * * * *